US010654683B2

(12) United States Patent
Dominguez et al.

(10) Patent No.: US 10,654,683 B2
(45) Date of Patent: May 19, 2020

(54) MONITORED BRAKING BLOCKS

(71) Applicant: OTIS ELEVATOR COMPANY, Farmington, CT (US)

(72) Inventors: Franck Dominguez, Loiret (FR); Frederic Beauchaud, Coullons (FR); Nicolas Guillot, Coullons (FR); Pascal Rebillard, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 270 days.

(21) Appl. No.: 15/739,298

(22) PCT Filed: Jul. 1, 2015

(86) PCT No.: PCT/IB2015/001347
§ 371 (c)(1),
(2) Date: Dec. 22, 2017

(87) PCT Pub. No.: WO2017/001884
PCT Pub. Date: Jan. 5, 2017

(65) Prior Publication Data

US 2018/0186596 A1 Jul. 5, 2018

(51) Int. Cl.
*B66B 1/32* (2006.01)
*B66B 1/34* (2006.01)
(Continued)

(52) U.S. Cl.
CPC ..... *B66B 1/32* (2013.01); *B66B 1/3476* (2013.01); *B66B 1/44* (2013.01); *B66B 5/18* (2013.01); *B66B 2201/00* (2013.01)

(58) Field of Classification Search
CPC ..... B66B 1/32; B66B 1/3476; B66B 1/44; B66B 5/18; B66B 2201/00
(Continued)

(56) References Cited

U.S. PATENT DOCUMENTS 3,918,552 A 11/1975 Kameyama et al.
7,614,481 B2 * 11/2009 Okamoto ..... B66B 5/06 187/305
(Continued)

FOREIGN PATENT DOCUMENTS

CN 85103125 A 10/1986
CN 101124140 A 2/2008
(Continued)

OTHER PUBLICATIONS

Office Action for Chinese Patent Application No. 201580081420.X; Application Filing Date Jul. 1, 2015; dated Jun. 12, 2019 (16 pages).
(Continued)

*Primary Examiner* — Anthony J Salata
(74) *Attorney, Agent, or Firm* — Cantor Colburn LLP

(57) ABSTRACT

An elevator system (100) includes an elevator car (102) that is configured to travel along a guide rail (104), and a braking assembly (116) coupled to the elevator car (102). The braking assembly (116) is configured to selectively operate in a disengagement mode that allows the elevator car (102) to travel along the guide rail (104), and an engagement mode that inhibits the elevator car (102) from traveling along the guide rail (104). The electronic braking assembly controller (128) is in signal communication with the braking assembly (116) and is configured to generate an electronic braking signal that activates the engagement mode of the braking assembly (116). When the engagement mode is activated, the elevator car (102) decelerates without exceeding a predetermined g-force (g) threshold regardless as to whether a load applied to the elevator car (102) changes such that the elevator car (102) is stopped at a floor landing (106).

13 Claims, 7 Drawing Sheets

(51) Int. Cl.
*B66B 5/18* (2006.01)
*B66B 1/44* (2006.01)

(58) Field of Classification Search
USPC ..... 187/247, 277, 283, 284, 286, 287, 288, 187/291, 391, 393, 394
See application file for complete search history.

(56) References Cited

U.S. PATENT DOCUMENTS

| | | | | |
|---|---|---|---|---|
| 7,686,139 | B2 * | 3/2010 | Kondo | B66B 1/32 187/277 |
| 7,730,998 | B2 * | 6/2010 | Takahashi | B66B 1/32 187/287 |
| 7,891,466 | B2 | 2/2011 | Okamoto et al. | |
| 7,896,136 | B2 * | 3/2011 | Shibata | B66B 5/02 187/287 |
| 8,167,094 | B2 * | 5/2012 | Ueda | B66B 5/0031 187/288 |
| 8,205,721 | B2 * | 6/2012 | Korhonen | B66B 1/32 187/288 |
| 8,267,224 | B2 | 9/2012 | Gremaud et al. | |
| 8,316,996 | B2 * | 11/2012 | Hashimoto | B66B 5/027 187/281 |
| 8,752,677 | B2 * | 6/2014 | Harkonen | B66B 1/34 187/391 |
| 10,214,381 | B2 * | 2/2019 | Studer | B66B 9/00 |
| 2010/0187047 | A1 | 7/2010 | Gremaud et al. | |
| 2017/0355560 | A1 * | 12/2017 | Herkel | B66B 5/0037 |
| 2018/0134519 | A1 * | 5/2018 | Kattainen | B66B 5/027 |
| 2019/0315593 | A1 * | 10/2019 | Rossi | B66B 5/0031 |

FOREIGN PATENT DOCUMENTS

| | | | |
|---|---|---|---|
| CN | 101743187 | A | 6/2010 |
| CN | 102282088 | A | 12/2011 |
| CN | 102414110 | A | 4/2012 |
| GB | 2153465 | A | 8/1985 |
| JP | 2008120521 | A | 5/2008 |
| JP | 2013119436 | A | 6/2013 |
| WO | 2010081935 | A1 | 7/2010 |
| WO | 2010100316 | A1 | 9/2010 |

OTHER PUBLICATIONS

International Search Report and Written Opinion; Application No. PCT/IB2015/001347; International Filing Date: Jul. 1, 2015; dated: Mar. 17, 2016; 12 pages.

Chan "Elevator Maintenance Techniques" Higher Education Press, First Edition, Oct. 1993 (pp. 56-57).

Second Office Action for Chinese Patent Application No. 201580081420.X; Application Filing Date Jul. 1, 2015; dated Jan. 2, 2020 (17 pages)

* cited by examiner

MONITORED BRAKING BLOCKS

CROSS REFERENCE TO RELATED APPLICATIONS

This application is a National Stage application of International Patent Application Serial No. PCT/IB2015/001347, filed Jul. 1, 2015, which is incorporated herein by reference in its entirety.

TECHNICAL FIELD

The present disclosure relates generally to elevator systems, and more particularly, to a braking system included in an elevator system.

BACKGROUND

Conventional elevator assemblies include one or more passenger cars that are equipped with braking blocks. The braking blocks are activated by a governor when an over-speed event occurs, i.e., when a speed of the elevator car exceeds a speed threshold. The braking blocks are assembled using a spring and an engagement member such as knurled roller or wedged block, for example. The braking blocks are progressively applied such that the engagement member pinches the guide rails to stop the elevator car while the spring cushions the deceleration.

The braking block spring typically has a fixed stiffness designed to stop the elevator car with a deceleration of approximately 1 g-force (g) when the car is at full load. Consequently, the deceleration of the car can vary depending on the number of passengers contained in the car. For example, when the engagement members are engaged and there are only a few passengers in the car, the deceleration of the car is much greater because the car is much lighter than the fully loaded case. This higher deceleration, however, can cause an unpleasant or even harsh stop for the passengers inside the car. Moreover, when the engagement member is engaged in response to an over-speed event, the car may be halted in the hoistway between floor landings. Consequently, the passengers may be confined within the car for an extended period of time before normal elevator operation is resumed.

SUMMARY

According to embodiment, an elevator system includes an elevator car that is configured to travel along a guide rail, and a braking assembly coupled to the elevator car. The braking assembly is configured to selectively operate in a disengagement mode that allows the elevator car to travel along the guide rail, and an engagement mode that inhibits the elevator car from traveling along the guide rail. The electronic braking assembly controller is in signal communication with the braking assembly and is configured to generate an electronic braking signal that activates the engagement mode of the braking assembly. When the engagement mode is activated, the elevator car decelerates without exceeding a predetermined g-force (g) threshold regardless as to whether a load applied to the elevator car changes such that the elevator car is stopped at a floor landing.

In addition to one or more of the features described above or below, or as an alternative, further embodiments include:

a feature, wherein the elevator system further includes at least one load sensor in signal communication with the electronic braking assembly controller, the load sensor configured to measure a current load applied to the elevator car, wherein the electronic braking assembly controller operates the braking assembly based on the current load;

a feature, wherein the braking assembly includes an engagement member configured to apply a frictional force when operating in the engagement mode, and wherein an amount of the frictional force is based on an amount of electrical current output by the electronic braking assembly controller;

at least one sensor in signal communication with the electronic braking assembly, the at least one sensor configured to detect an over-speed event of the elevator car when a speed of the elevator car exceeds a speed threshold, wherein the electronic braking signal activates the engagement mode of the braking assembly to stop the elevator car in response to the over-speed event.

a feature, wherein the electronic braking assembly controller is configured to determine a desired deceleration at which to slow the elevator car that does not exceed the g-force threshold in response to the over-speed event, and to adjust the amount of electrical current to maintain the desired deceleration.

at least one position sensor in signal communication with the electronic braking assembly controller, wherein the at least one position sensor is configured to determine a position of the elevator car with respect to at least one floor landing, and wherein the electronic braking assembly controller is configured to adjust the amount of frictional force such that the elevator car is stopped at the floor landing; and a feature, wherein the g-force threshold ranges from approximately 0 g to approximately 1 g.

According to another embodiment, a method of braking an elevator car included in an elevator system comprises setting a maximum g-force (g) threshold at which decelerate the elevator when a braking event is required. The method further comprises driving the elevator car along a guide rail, and disengaging a braking assembly coupled to the elevator car such that the elevator car travels along the guide rail when a braking event is not required. The method further comprises engaging the braking assembly to inhibit the elevator car from traveling along the guide rail when a braking event is required. The method further comprises adjusting the braking assembly to decelerate the elevator car without exceeding the maximum g-force threshold regardless as to whether a load applied to the elevator car changes such that the elevator car is stopped at a floor landing.

In addition to one or more of the features described above or below, or as an alternative, further embodiments include:

measuring a current load applied to the elevator car, and adjusting the braking assembly based on the current load to maintain a deceleration that does not exceed the g-force threshold;

a feature, wherein the adjusting the braking assembly includes delivering an electrical current to the braking assembly, and wherein the braking assembly applies a frictional force against the guide rail to decelerate the elevator car in response to the electrical current;

detecting an over-speed event when a speed of the elevator car exceeds a speed threshold, and engaging the braking assembly in response to detecting the over-speed event;

a feature, wherein an amount of the frictional force varies according to an amount of electrical current delivered to the braking assembly;

a feature, wherein the amount of electrical current is based on the current load to maintain a deceleration that does not exceed the g-force threshold;

determining a position of the elevator car with respect to at least one floor landing, and adjusting the braking assembly such that the elevator car is stopped at the floor landing; and a feature, wherein the g-force threshold ranges from approximately 0 g to approximately 1 g

BRIEF DESCRIPTION OF THE DRAWINGS

Various embodiments include features that are particularly pointed out and distinctly claimed in the claims at the conclusion of the specification. The foregoing and other features are apparent from the following detailed description taken in conjunction with the accompanying drawings in which:

DETAILED DESCRIPTION

Figure 1:
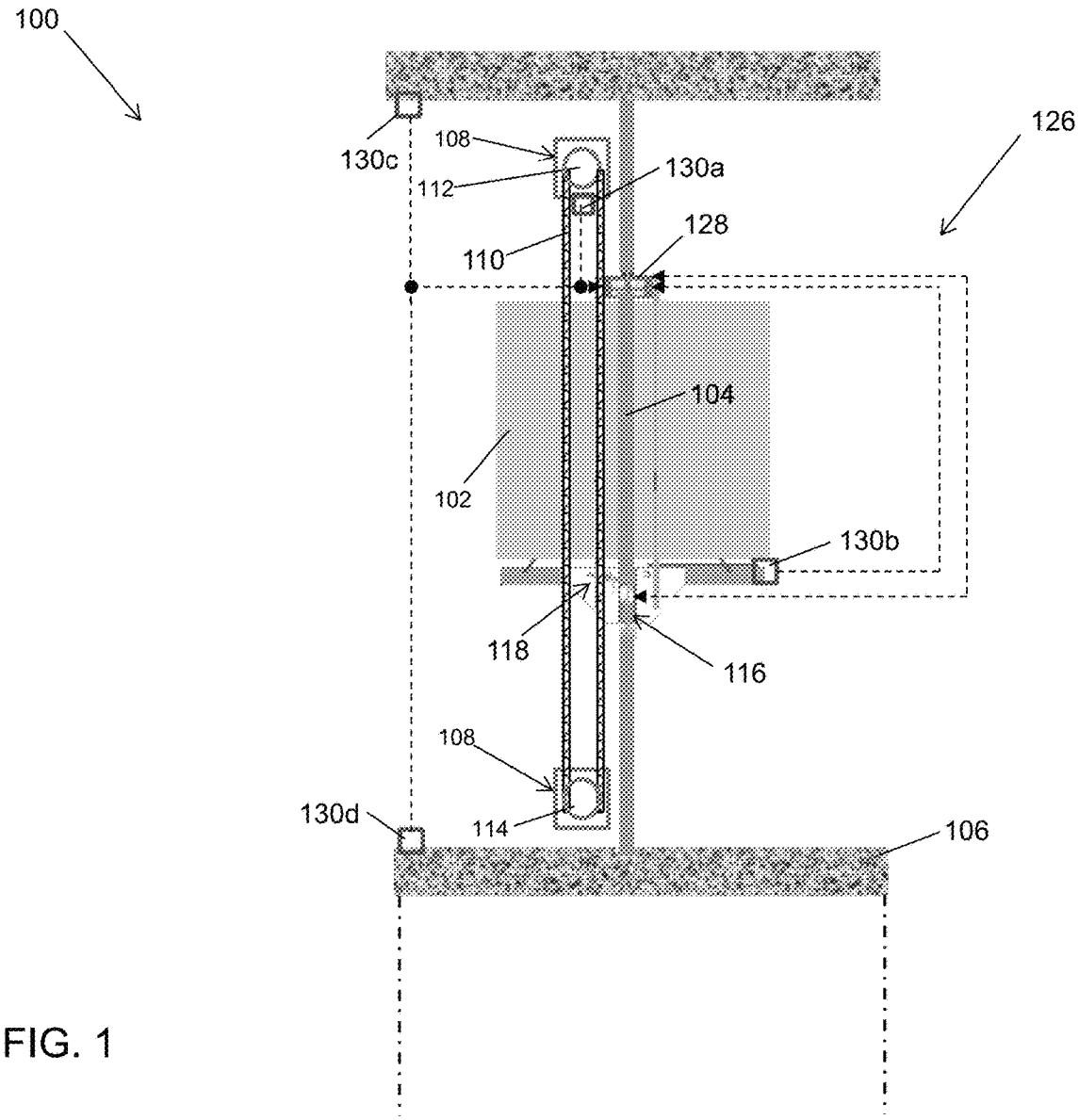
FIG. 1 is a diagram of an elevator system including a braking block control system according to a non-limiting embodiment.

Various embodiments described herein provide an elevator system configured to monitor a braking assembly of an elevator car and electronically adjust the operation of the braking assembly to control the deceleration and stopping altitude of the elevator car. In this manner, the elevator car can be slowed without exceeding a maximum deceleration regardless as to current load applied to the elevator car. In one example, the elevator car can be slowed in response to an over-speed event without exceeding a maximum deceleration regardless as to the number of passengers contained in the elevator car such that the elevator car is stopped at a floor landing.

According to at least one non-limiting embodiment, an elevator system is provided that includes an electronic braking block control system that electronically controls operation of a braking block assembly. For example, the elevator system includes an electronic braking block control system associated with hoisting ropes which pass over a motor driven traction sheave. The ropes suspend and hoist an elevator car at one side of the sheave and, at the opposite side of the sheave, are attached to a counterweight. The car is guided at opposite sides by guide rails and rollers as understood by one of ordinary skill in the art. The sheave and its supporting apparatus are typically supported by fixed beams, and the braking block assembly is supported by the beam, although it may be otherwise located on a fixed support. Although the electronic braking block control system will be described with respect to a tension-member elevator system, it should be appreciated that the electronic braking block control system may be implanted in other types of elevator systems including, but not limited to, a self-propelled car elevator system.

The electronic braking block control system monitors various conditions including, but not limited to, an altitude of the car, a position of the car with respect to one or more floor landings, a load applied to the car (e.g., weight of the car) and a speed of the car, and varies the engagement intensity applied by the braking block assembly (e.g., the pressure applied by the braking block upon a respective rail). In this manner, the elevator car can be decelerated and stopped without exceeding a predetermined g-force (g) threshold irrespective to load changes inside the elevator car changes. It should be appreciated that g-force is a unit of measurement indicating the inertial stress on a body undergoing rapid acceleration, expressed in multiples of the acceleration of gravity.

Furthermore, at least one embodiment provides a feature where the elevator car can be decelerated to a stop while also avoiding various undesirable residual movements such as, for example, underside movements during loading and unloading of the car, slipping of the coated steel belt (CSB) on the motor sheave and/or residual car bouncing. Moreover, the braking block control system can engage the braking block assembly in response to an over-speed event, while controlling the deceleration in such a manner that the elevator car is stopped at a floor landing, as opposed to being instantaneously stopped between floor landings. In this manner, passengers can be evacuated from the elevator car at the floor landing instead of remaining confined in the elevator car until the car can be safely moved to a floor landing.

Figure 2:
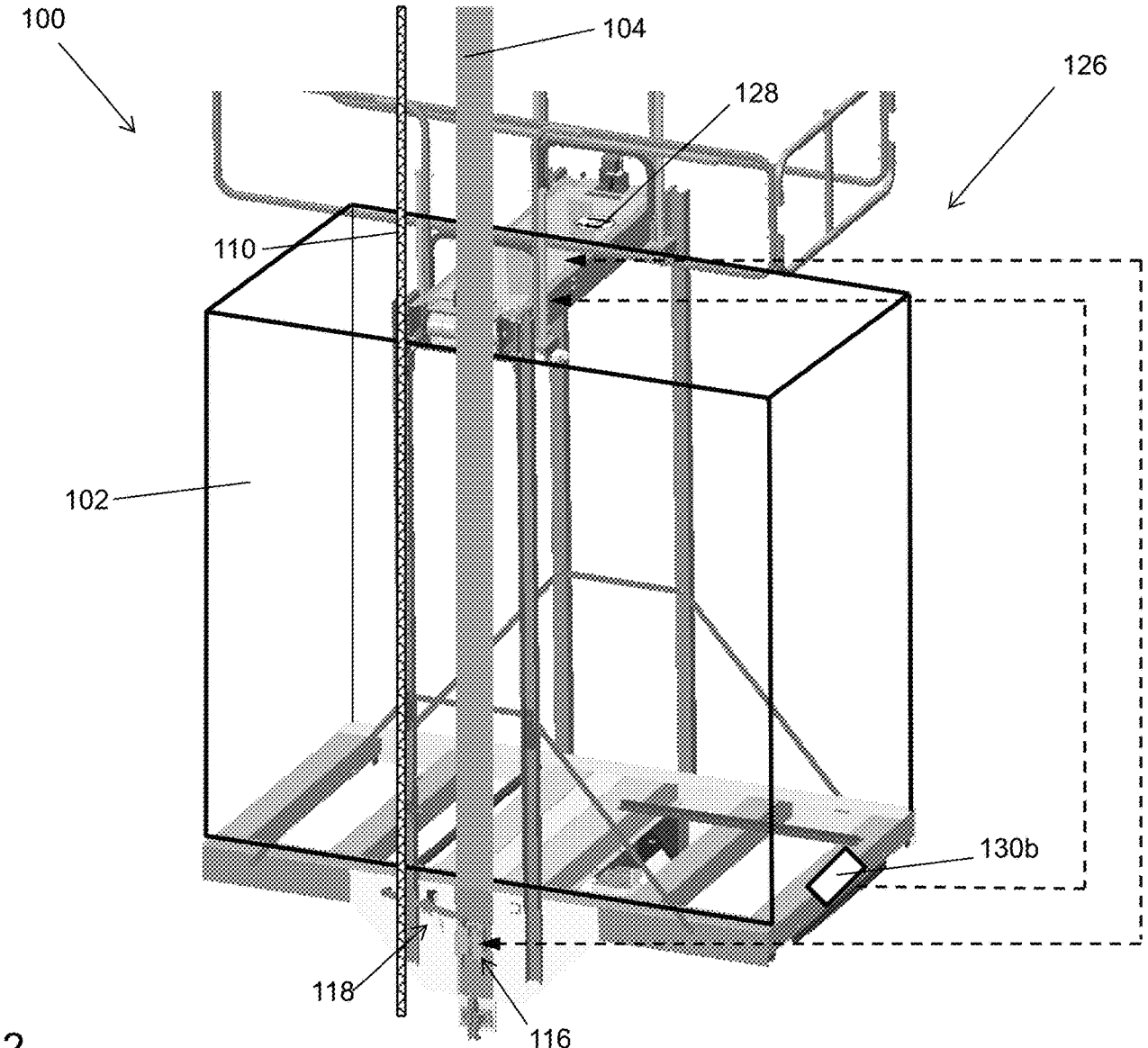
FIG. 2 is a perspective view of an elevator system including a braking block control system that controls operation of a braking block assembly installed on a passenger car according to a non-limiting embodiment.

With reference now to FIGS. 1-2, an elevator system 100 is illustrated according to a non-limiting embodiment. The elevator system 100 includes an elevator car 102 that moves along guide rails 104 in a known manner using tension members such as ropes or cables (not shown) driven by a motor (not shown) to transfer the elevator car 102 to one or more floor landings 106. A governor assembly 108 prevents the elevator car 102 from exceeding a maximum speed. According to a non-limiting embodiment, the governor assembly 108 includes, for example, a governor cable 110, a governor sheave 112, a tension sheave 114, and a braking block assembly 116. The governor sheave 112 and the tension sheave 114 are located at opposite ends of a loop formed by the governor cable 110 which travels with the elevator car 102. The braking block assembly 116 is coupled to the governor cable 110 via a mechanical linkage 118. For example, the braking block assembly 116 includes two braking blocks installed on opposing sides of the car frame. Although an electronic braking block control system will be described with respect to a tension-member elevator system 100, it should be appreciated that the electronic braking block control system may be implanted in other types of elevator system including, but not limited to, self-propelled car elevator systems. It should be appreciated that other types of governor assemblies may be implanted in the elevator system including, but not limited to, car-mounted governor assemblies.

Figure 3A:
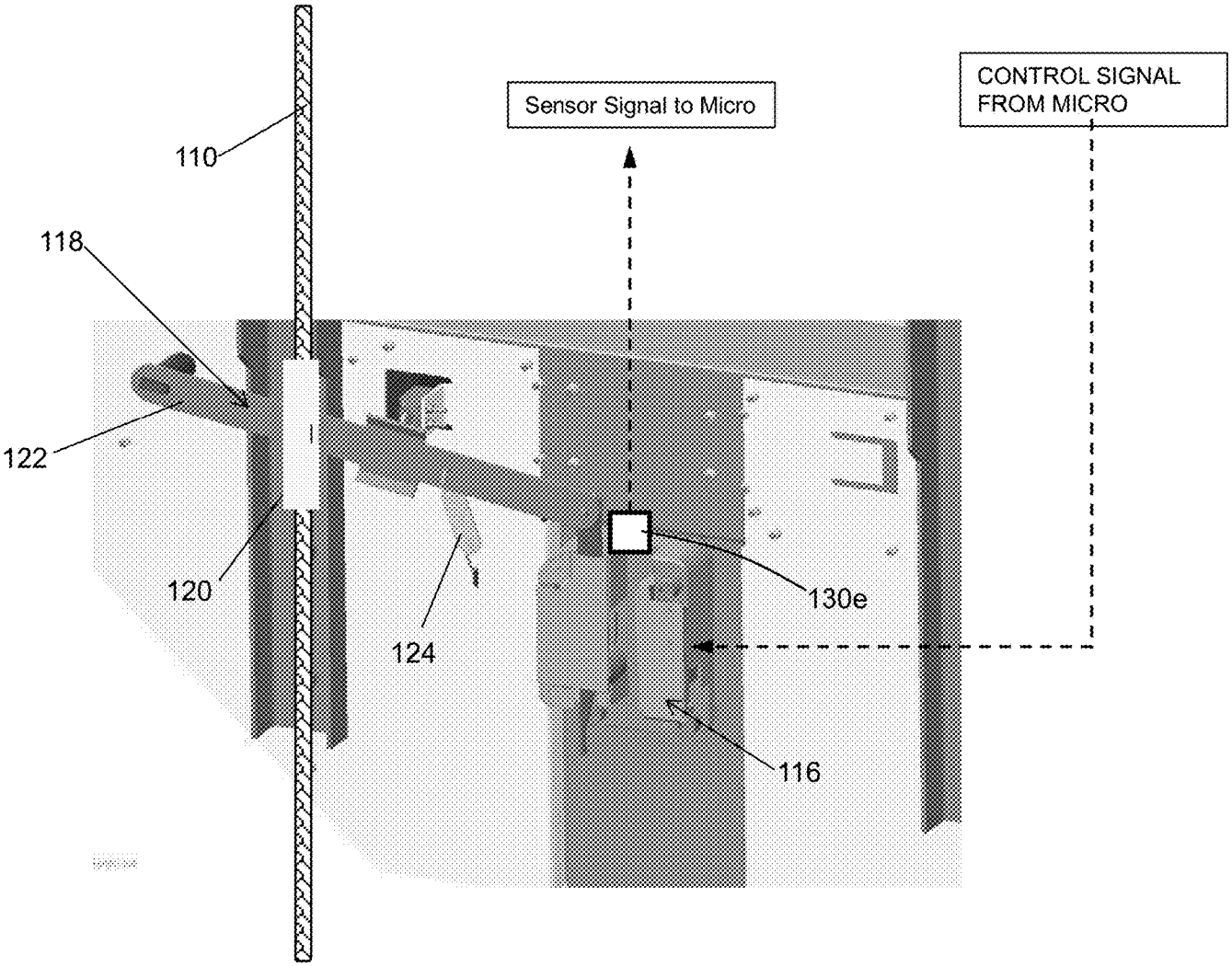
FIG. 3A is a close-up view of a deactivated braking block assembly included in the elevator assembly illustrated in FIG. 2.
Figure 3B:
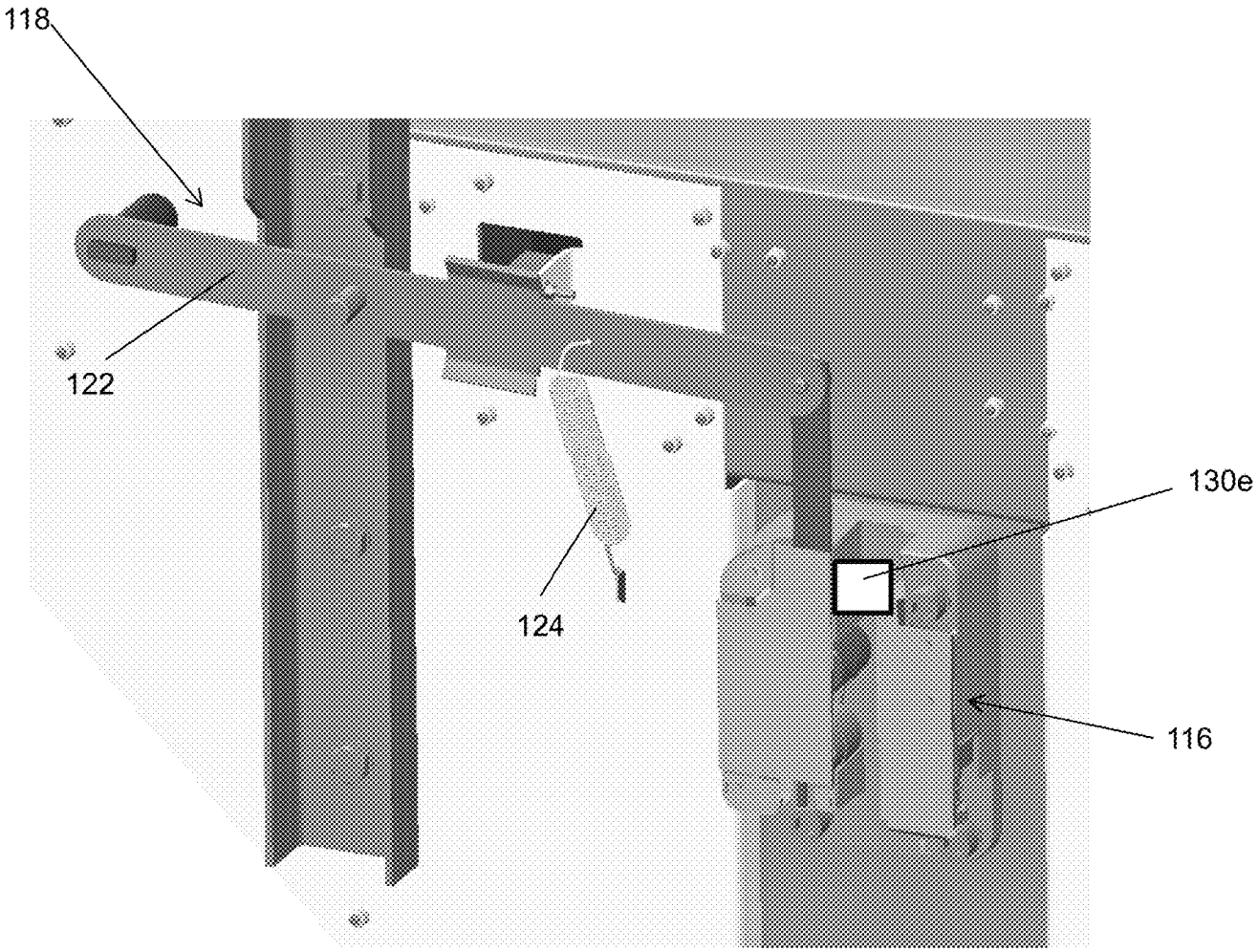
FIG. 3B is a close-up view of an activated braking block assembly included in the elevator assembly illustrated in FIG. 2.

Turning to FIGS. 3A-3B, the mechanical linkage 118 includes a block link 120 that is coupled to the governor cable 110, a block lever 122, and a lever spring 124. The block lever 122 includes a first end coupled to the block link 120 and a second end coupled to the braking block assembly 116. The block lever 122 is configured to pivot between an engaged position and a disengaged position. When the block lever 122 is placed in the disengaged position as illustrated in FIG. 3A, the braking block assembly 116 is disengaged and spaced apart from the guide rail 104. Accordingly, no friction is applied to the guide rail 104 and the elevator car 102 moves freely between the floor landings 106. When, however, the block lever 122 is placed in the engaged position as illustrated in FIG. 3B, the braking block assembly 116 is engaged against the guide rail 104 and applies friction thereto. The friction applied by the braking block assembly 116 decelerates the elevator car 102 ultimately causing the elevator car 102 to stop. The lever spring 124 biases the block lever 122 in the disengaged position unless an over-speed event occurs as discussed in greater detail below.

The illustrated governor assembly 108 operates in a known manner. In the case of an over-speed event, i.e., where the speed of the elevator car 102 exceeds a speed threshold, the governor assembly 108 is automatically initiated and exerts a braking force on the governor sheave 112. In turn, the governor cable 110 pulls up on the mechanical linkage 118 thereby placing the governor lever 122 into the engaged position and activating the braking block assembly 116 installed on elevator car 102. When activated, the braking block assembly 116 is forced against the guide rail 104 and applies a braking force (e.g., frictional force) to the guide rail 104 thereby decelerating and stopping the elevator car 102.

Figure 4:
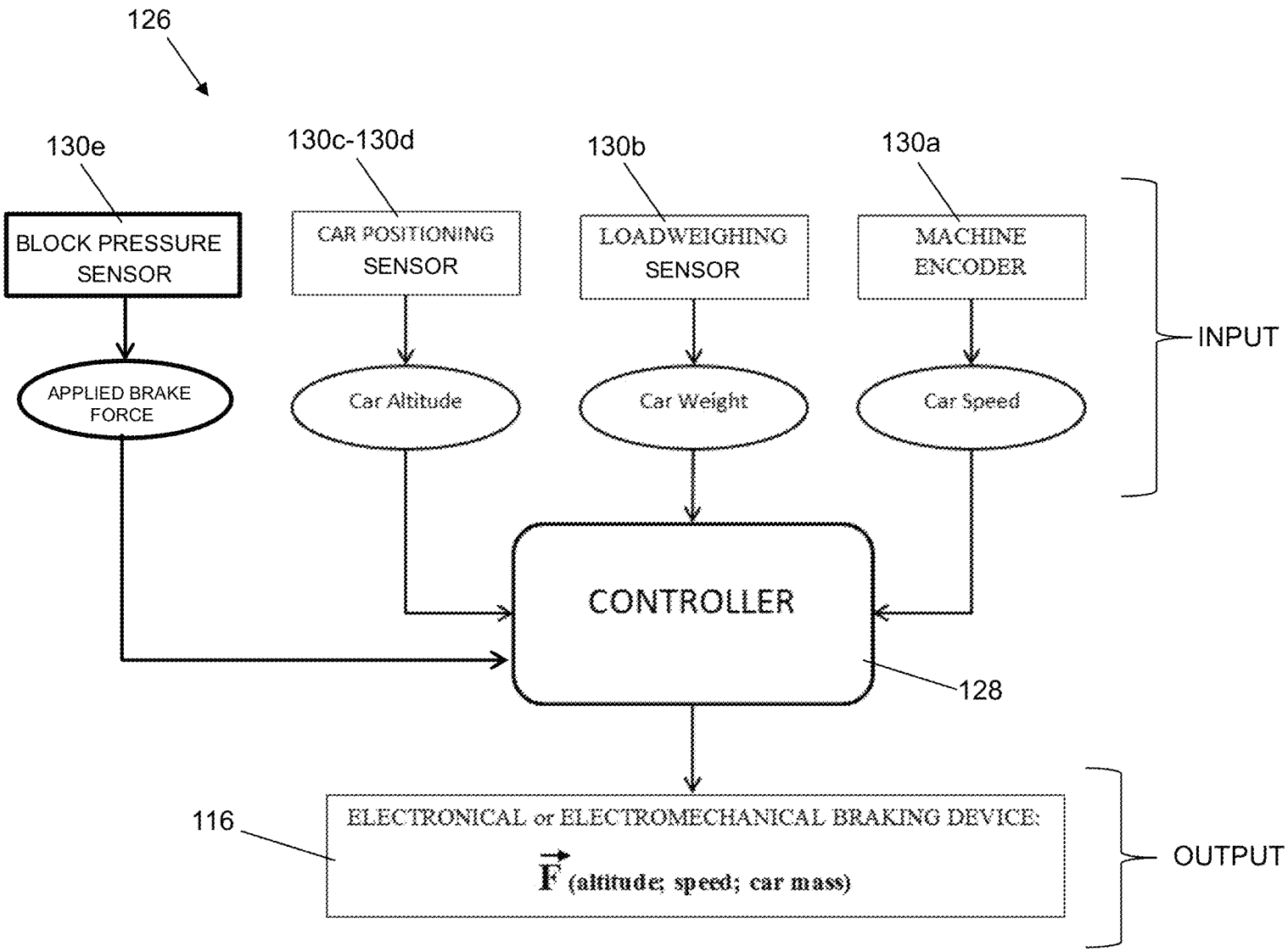
FIG. 4 is a block diagram of a braking block control system according to a non-limiting embodiment.

The elevator system 100 further includes an electronic braking block control system 126 that electronically controls operation of the braking block assembly 116. A block diagram of the electronic braking block control system 126 is illustrated in FIG. 4 according to a non-limiting embodiment. The electronic braking block control system 126 includes an electronic microcontroller 128 in signal communication with the braking block assembly 116, and one or more electronic sensors 130*a*-130*e* in signal communication with the microcontroller 128. The microcontroller 128 includes a computer processor and computer readable instructions. Accordingly, the microcontroller 128 controls the operation of the elevator system and/or the braking block assembly 116 based on signals output from the sensors 130*a*-130*e*, as discussed in greater detail below. The sensors include, but are not limited to, a car speed sensor 130*a*, a car load weight sensor 130*b*, car position sensors 130*c*-130*d*, and a brake block pressure sensor 130*e*.

The car speed sensor 130*a* may include, for example, a machine encoder. The machine encoder is configured to rotate and output a signal indicative of the rotational angle. The rotational angle can then be used to determine a direction of the elevator. Moreover, the frequency of the output signal can be used to determine the speed of the elevator car. The car load weight sensor 130*b* can sense the load of the elevator car 102. The load includes, for example, a weight applied to the elevator car 102 based on a current number of items, passengers, etc., supported by the elevator car 102 at a given time period. The brake block pressure sensor 130*e* can sense the level of pressure applied by the brake block assembly 116 onto the guide rail 104. The car position sensors 130*c*-130*d* are coupled to a respective floor landing 106 and can directly inform the microcontroller 128 of an altitude of the elevator car 102 and/or a position of the elevator car 102 with respect to at least one floor landing 106, including, e.g., the $1^{st}$ floor landing or, the next available landing floor, which can be determined according to data related to the speed of the elevator car and the position of the car in the hoistway. Based on the speed and the car position, the distance traveled by the car during braking according to known deceleration can be calculated.

The microcontroller 128 receives each signal output from a respective sensor 130*a*-130*e* and can control the operation of the braking block assembly 116 should an over-speed event occur. For example, the microcontroller 128 can detect the occurrence of an over-speed event when the car speed sensor 130*a* outputs a speed signal that exceeds a threshold value. In response to detecting the over-speed event, the microcontroller 128 generates an activation signal (e.g., an electrical current) that drives one or more solenoids in the braking block assembly 116. In turn, the solenoids are energized and force the engagement member (e.g., wedged block, knurled roller, etc.) included in the braking block assembly against the guide rail 104. The friction between the engagement member and the guide rail 104 decelerates the elevator car 104 until the elevator car 102 is brought to a complete stop.

As mentioned above, at least one embodiment of the elevator system 100 provides a feature that the elevator car can be stopped at a predetermined landing floor, which may be the next available floor landing, for example, or may be another desired floor landing to receive the elevator car. Using the measured speed of the elevator and the maximum deceleration (e.g., the maximum deceleration set by the elevator manufacturer), the distance traveled by the elevator car during braking with maximum deceleration can be calculated. If the distance traveled would be less than the distance to the predetermined landing, then the braking assembly can be initiated later, or the intensity of the braking assembly can be adjusted such that the deceleration is adjusted until the elevator car reaches the desired elevator floor.

Unlike in conventional elevator systems, however, the microcontroller 128 included in the braking block control system 126 is aware of the load applied to the elevator car 102 based on the load weight sensor 130*b*, and is also aware of the force applied by the braking block assembly based on the feedback pressure signal provided by the block sensor 130*e*. Accordingly, the microcontroller 128 can control the amount of current applied to the solenoid, thereby adjusting the pressure applied by the engagement member. Rather than forcing the elevator car 102 to a sudden and abrupt halt, the microcontroller 128 can control the intensity at which the braking block assembly applies the engagement member, thereby decelerating the elevator car 102 without exceeding a predetermined g-force threshold and bringing the elevator car to a gradual stop regardless as to the load (e.g., number of passengers) applied to the elevator car 102. The predetermined g-force threshold ranges, for example, from approximately 0 g to approximately 1 g. Therefore, the braking block control system 126 allows passengers to experience a more comfortable environment should an over-speed event occur.

Moreover, the microcontroller 128 is also aware of the position of the elevator car 102 with respect to the floor landings 106 based on the position signals output by the car position sensors 130*c*-130*d* and/or a signal output from a machine encoder. This allows the microcontroller 128 to control the intensity applied by the braking block assembly 116 such that the elevator car 102 is gradually brought to a stop at a floor landing 106 instead of between floor landings. In this manner, passengers can be quickly and conveniently be unloaded from the elevator car following an over-speed event.

According to a non-limiting embodiment, the elevator car 102 can be decelerated at a constant deceleration over time without exceeding a predetermined g-force (e.g., 1 g). The constant deceleration can be calculated, for example, from a position of the elevator car 102 relative to the next available landing and the car speed. For instance, if an elevator car 102 is located at a defined position in the hoistway and the next landing floor is available using a maximum deceleration of 1 g, the deceleration will be lower in a situation (a) with a lower car speed than in a situation (b) with a higher car speed.

According to another non-limiting embodiment, the deceleration of the elevator car 102 can be smoothly varied between a pair of threshold ranges. For example, over the duration of the deceleration time (e.g., the time during which the elevator car is decelerated until coming to a stop), the declaration of the elevator car 102 can be smoothly varied between a threshold range including a minimum threshold value of −1.0 g (i.e. free fall) and a maximum threshold value of +1.0 g. It should be appreciated that the threshold range described is non-limiting and other minimum and maximum ranges can be implemented.

The position of the elevator car 102 and the actual deceleration of the elevator car 102 can be utilized to determine a preferred landing at which to stop the elevator car 102 according to another non-limiting embodiment. For instance, the microcontroller 128 may calculate that the actual deceleration of the elevator 102 may not allow the elevator car 102 to stop at the following immediate floor landing (e.g. floor 5) without exceeding the maximum threshold value (e.g. +1.0 g). Accordingly, the microcontroller 128 may decide to stop the elevator car 102 at another floor landing (e.g., the next closest floor landing 4) so as to stop the elevator car 102 without exceeding the maximum threshold value (e.g. +1.0 g).

Although the maximum threshold is described above to determine what floor landing to stop the elevator car 102, it should be appreciated that the microcontroller 128 may calculate two or more estimated decelerations corresponding to two different possible floor landings, respectively. In this manner, the microcontroller 128 can select a floor landing to stop the elevator car 102 based on which estimated deceleration will provide the passengers with most comfortable experience (i.e., the least applied g-force). For instance, if stopping the elevator car 102 at the next immediate floor landing (e.g. floor 5) will result in a g-force of 0.9 g, but stopping the elevator car 102 at the second closest floor landing (e.g., floor 4) will result in a g-force of 0.3 g, the microcontroller 128 may choose to by-pass the next immediate floor and instead stop the elevator car1 102 at the second closest floor landing.

The braking block control system 126 is described above in terms of an over-speed event. It should be appreciated, however, that the braking block control system 126 can be activated in other scenarios. For example, the braking block assembly 126 can be activated to avoid any uncontrolled car movement during various stations including, but not limited to, loading and unloading of the elevator car 102, slippage of the CSB on the motor sheave, and bouncing of the elevator car 102. It should also be appreciated that the microcontroller 128 can control the braking block assembly 116 without relying on the mechanical linkage 118 and the governor assembly. Accordingly, the mechanical linkage 118 and the governor assembly may be used as an auxiliary backup system, while the electronic braking control system 126 is primarily responsible for stopping the elevator car 102 in response to an over-speed event. According to another embodiment, an elevator system 100 is provided that omits the mechanical linkage 118 and the governor assembly such that the braking control system 126 is exclusively responsible for stopping the elevator car 102 in response to an over-speed event.

Figure 5:
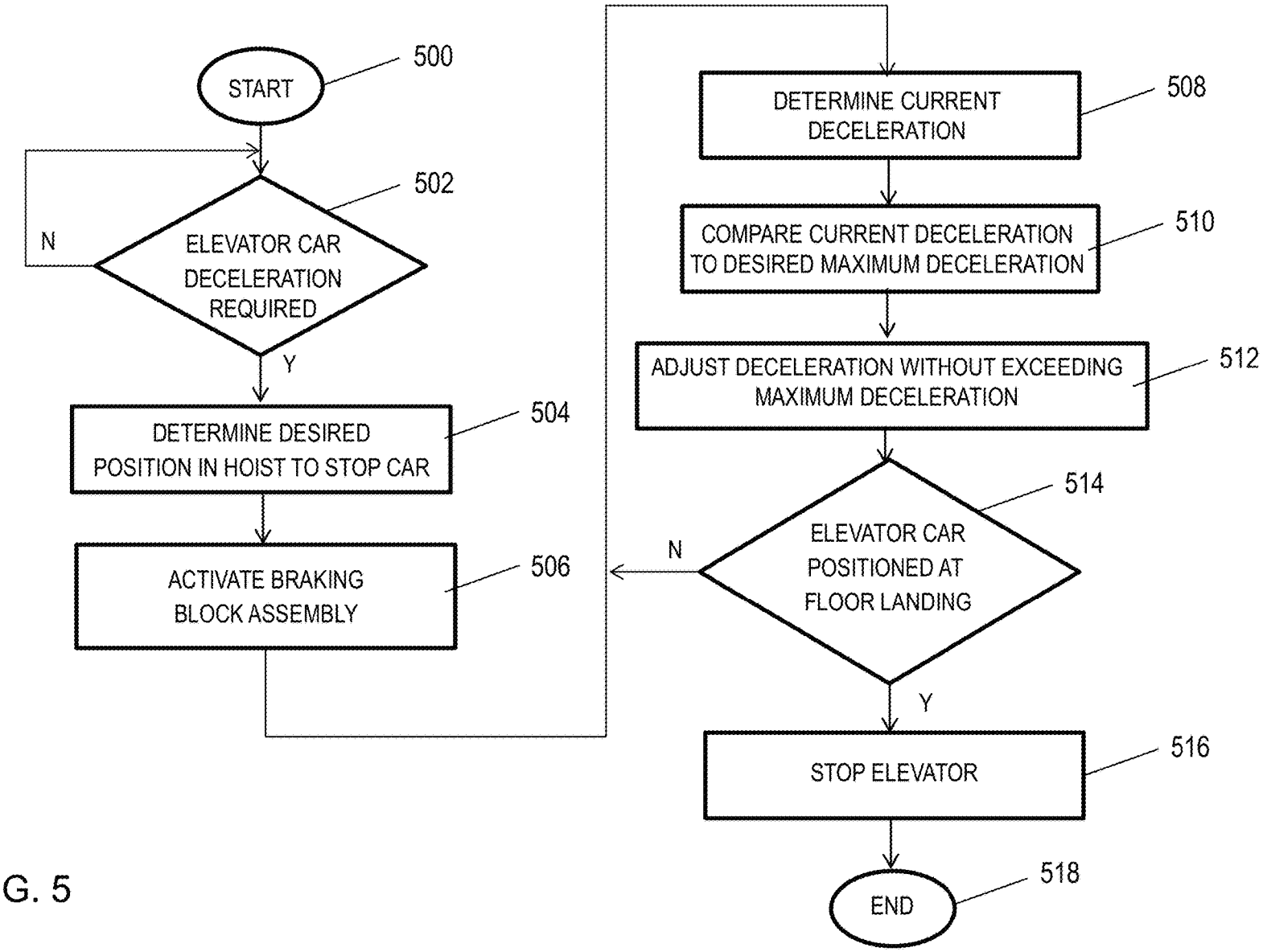
FIG. 5 is a flow diagram illustrating a method of braking an elevator car included in an elevator system according to a non-limiting embodiment.

Turning now to FIG. 5, a flow diagram illustrates a method of braking an elevator car included in an elevator system according to a non-limiting embodiment. The method begins at operation 500, and at operation 502 a determination as to whether deceleration of an elevator car is required. For example, an over-speed event can be detected when a speed of the elevator car exceeds a predetermined speed threshold. In response to detecting the over-speed event, the system determines that the elevator car requires braking. When the elevator car does not require braking, the method continues monitoring whether the elevator car requires braking at operation 502. When, however, the elevator car requires braking, the method determines a desired position, e.g., a desired altitude, at which to stop the car at operation 504. For example, the desired position can correspond with a floor landing. The desired floor landing may be the floor landing closest to the elevator car, or may be another floor landing that can receive the elevator car.

Turning to operation 506, the braking block assembly is activated to initiate deceleration of the elevator car. According to an embodiment, the elevator car is decelerated without allowing the elevator car to come to a complete stop until the elevator car reaches a floor landing, as discussed in greater detail below. At operation 508, a current deceleration of the elevator car is determined. The current deceleration can be determined, for example, based on a monitored speed of the elevator car and traveled distance of the elevator car (e.g., meter/square second) as understood by one of ordinary skill in the art. At operation 510, the current deceleration is compared to a desired maximum deceleration. According to an embodiment, the maximum deceleration is pre-set by the manufacturer of the elevator system. The maximum deceleration can be determined, for example, as maximum deceleration at which passengers remain comfortable while the elevator car is decelerated.

With reference now to operation 512, the deceleration of the elevator car is adjusted without exceeding the maximum deceleration. The deceleration can be adjusted, for example, by adjusting the braking intensity applied by a braking assembly installed on the elevator car. According to a non-limiting embodiment, the braking assembly includes an engagement member that is forced against a guide rail of the elevator system in response to an electrical current. The amount of electrical current controls the mount of frictional force applied to the guide rail via the engagement member, thereby controlling the deceleration of the elevator car. In this manner, the elevator car can be decelerated without exceeding the maximum deceleration during any over-speed event, regardless as to the load applied to the elevator car (e.g., the number of passengers contained in the elevator car). At operation 514, a determination is made as to whether the elevator car is positioned at a floor landing. When the elevator car is positioned at a floor landing, the elevator car is stopped at operation 516, and the method ends at operation 518. When, however, the elevator car is not positioned at a floor landing, the method returns to operation 508, and continues to monitor the current deceleration of the elevator such that the deceleration can ultimately be adjusted without exceeding the maximum deceleration until the elevator car is positioned at the floor landing.

Figure 6:
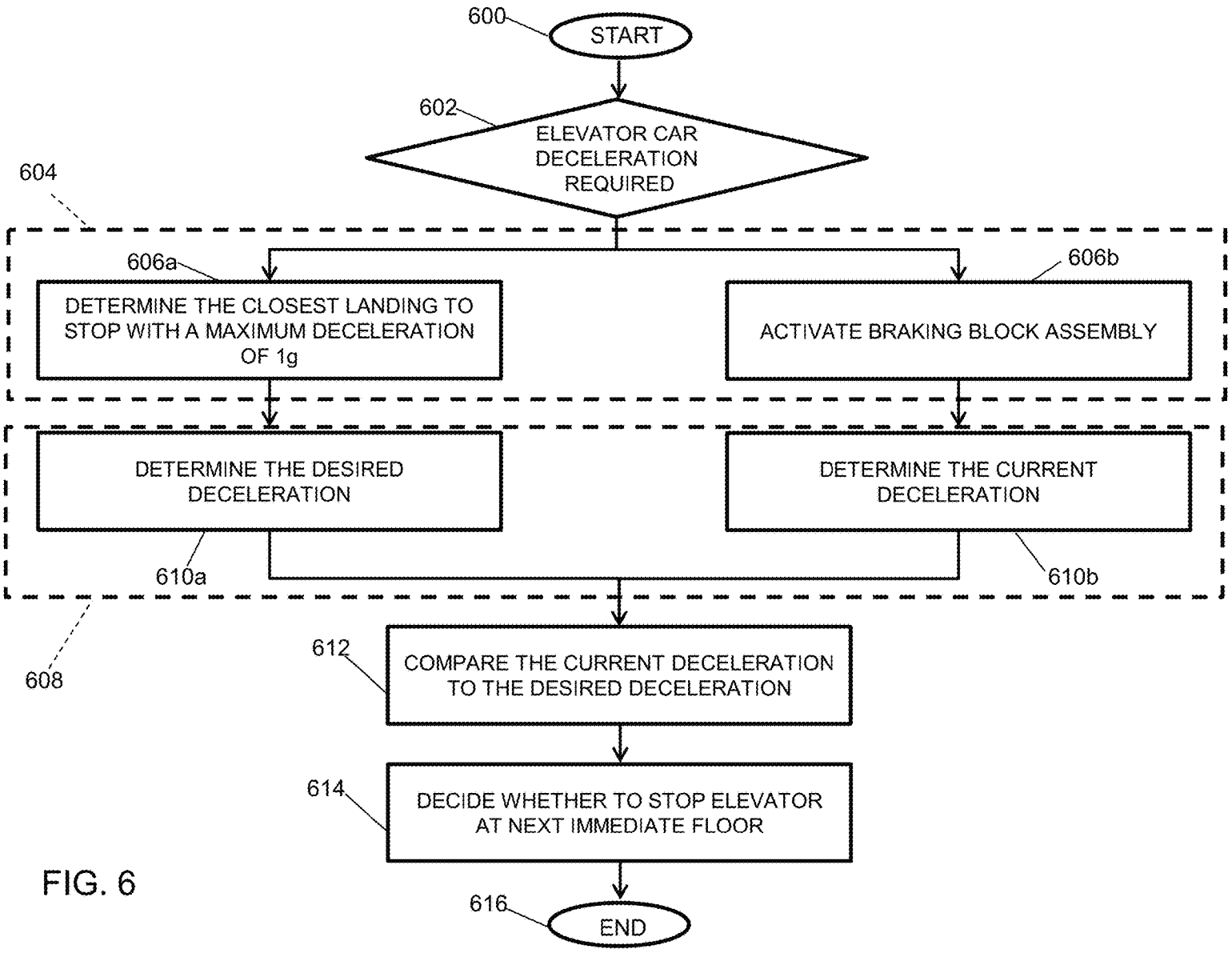
FIG. 6 is a flow diagram illustrating a method of braking an elevator car included in an elevator system according to another non-limiting embodiment.

Turning now to FIG. 6, a flow diagram illustrates a method of braking an elevator car included in an elevator system according to another non-limiting embodiment. The method begins at operation 600, and at operation 602, a determination is made as to whether an elevator car deceleration is required. At operation 604, a braking block assembly is activated so as to stop the elevator car. For example, at sub-operation 606*a*, the closest landing to stop the elevator car without exceeding a maximum deceleration (e.g., 1 g) is determined. In addition, the braking block assembly can be simultaneously activated at sub-operation 606*b* to begin decelerating the elevator car. Turning to operation 608, the desired deceleration and actual/current deceleration are determined. For example, the desired deceleration (e.g., a maximum g-force) that will stop the elevator car 102 in a smooth and convenient manner to be experienced by the passengers is determined at sub-operation 610*a*, while the actual deceleration of the elevator car is determined at sub-operation 610*b*. At operation 612, the actual deceleration is compared to the desired deceleration. At operation 614, a decision is made whether to stop the elevator car at the next immediate floor, and the method ends at operation 616. For example, if the actual deceleration will not allow the elevator car to be stopped at the next immediate floor without exceeding the desired deceleration, the next immediate floor can be by-passed, and the elevator car can be smoothly stopped at the next closest floor, for example, without exceeding the desired deceleration.

While various non-limiting embodiments have been described in detail in connection with only a limited number of embodiments, it should be readily understood that the embodiments are not limited to such disclosed embodiments. Rather, the embodiments can be modified to incorporate any number of variations, alterations, substitutions or equivalent arrangements not heretofore described, but which are commensurate with the spirit and scope of the inventive teachings. Additionally, while various embodiments have been described, it is to be understood that one or more embodiments may include only some of the described embodiments. Accordingly, the aforementioned embodiments are not to be seen as limited by the foregoing description.

The invention claimed is:

1. An elevator system comprising:

an elevator car configured to travel along a guide rail;

a braking assembly coupled to the elevator car, the braking assembly configured to selectively operate in a disengagement mode that allows the elevator car to travel along the guide rail, and an engagement mode that inhibits the elevator car from traveling along the guide rail; and an electronic braking assembly controller in signal communication with the braking assembly, the electronic braking assembly controller configured to generate an electronic braking signal that activates the engagement mode of the braking assembly and decelerate the elevator car without exceeding a predetermined g-force (g) threshold irrespective to load changes inside the elevator car such that the elevator car is stopped at a floor landing, wherein adjusting the braking assembly includes delivering an electrical current to the braking assembly, and wherein the braking assembly applies a frictional force against the guide rail to decelerate the elevator car in response to the electrical current, and wherein an amount of delivered electrical current is based on the current load to maintain a deceleration that does not exceed the g-force threshold.

2. The elevator system of claim 1, wherein the elevator system further includes at least one load sensor in signal communication with the electronic braking assembly controller, the load sensor configured to measure a current load applied to the elevator car, wherein the electronic braking assembly controller operates the braking assembly based on the current load.

3. The elevator system of claim 2, wherein the braking assembly includes an engagement member configured to apply a frictional force when operating in the engagement mode, and wherein an amount of the frictional force is based on the amount of electrical current output by the electronic braking assembly controller.

4. The elevator system of any of claim 3, further comprising at least one sensor in signal communication with the electronic braking assembly, the at least one sensor configured to detect an over-speed event of the elevator car when a speed of the elevator car exceeds a speed threshold, wherein the electronic braking signal activates the engagement mode of the braking assembly to stop the elevator car in response to the over-speed event.

5. The elevator system of any of claim 4, wherein the electronic braking assembly controller is configured to determine a desired deceleration at which to slow the elevator car that does not exceed the g-force threshold in response to the over-speed event, and is configured to adjust the amount of electrical current to maintain the desired deceleration.

6. The elevator system of claim 5, further comprising at least one position sensor in signal communication with the electronic braking assembly controller, wherein the at least one position sensor is configured to determine a position of the elevator car with respect to at least one floor landing, and wherein the electronic braking assembly controller is configured to adjust the amount of frictional force such that the elevator car is stopped at the floor landing.

7. The elevator system of claim 6, wherein the g-force threshold ranges from approximately 0 g to approximately 1 g.

8. A method of braking an elevator car included in an elevator system, the method comprising:

setting a maximum g-force (g) threshold at which to decelerate the elevator when a braking event is required;

driving the elevator car along a guide rail;

disengaging a braking assembly coupled to the elevator car such that the elevator car travels along the guide rail when a braking event is not required;

engaging the braking assembly to inhibit the elevator car from traveling along the guide rail when a braking event is required; and adjusting the braking assembly to decelerate the elevator car without exceeding the maximum g-force threshold regardless as to whether a load applied to the elevator car changes such that the elevator car is stopped at a floor landing, wherein adjusting the braking assembly includes delivering an electrical current to the braking assembly, and wherein the braking assembly applies a frictional force against the guide rail to decelerate the elevator car in response to the electrical current, and wherein an amount of delivered electrical current is based on the current load to maintain a deceleration that does not exceed the g-force threshold.

9. The method of claim 8, further comprising measuring a current load applied to the elevator car, and adjusting the braking assembly based on the current load to maintain a deceleration that does not exceed the g-force threshold.

10. The method of claim 8, wherein an amount of the frictional force varies according to an amount of electrical current delivered to the braking assembly.

11. The method of claim of any of claims 10, further comprising detecting an over-speed event when a speed of the elevator car exceeds a speed threshold, and engaging the braking assembly in response to detecting the over-speed event.

12. The method of claim 11, further comprising determining a position of the elevator car with respect to at least one floor landing, and adjusting the braking assembly such that the elevator car is stopped at the floor landing.

13. The method of claim 12, wherein the g-force threshold ranges from approximately 0 g to approximately 1 g.

* * * * *